United States Patent [19]

Dearth et al.

[11] 4,227,990

[45] Oct. 14, 1980

[54] THERMAL CRACKING OF RETORT OIL

[75] Inventors: James D. Dearth, Dallas; Robert H. Smith, Plano, both of Tex.

[73] Assignee: Atlantic Richfield Company, Los Angeles, Calif.

[21] Appl. No.: 962,510

[22] Filed: Nov. 20, 1978

[51] Int. Cl.[3] ..... C01G 1/00

[52] U.S. Cl. ..... 208/8 R; 208/11 R; 208/127; 208/153

[58] Field of Search ..... 208/8 R, 11 R

[56] References Cited

U.S. PATENT DOCUMENTS

| | | | |
|---|---|---|---|
| 3,039,955 | 6/1962 | Honnold et al. | 208/8 R |
| 3,058,903 | 10/1962 | Otis | 208/11 R |
| 3,844,930 | 10/1974 | Wunderlich et al. | 208/11 R |

*Primary Examiner*—Herbert Levine

*Attorney, Agent, or Firm*—M. David Folzenlogen

[57] ABSTRACT

The thermal cracking of retort oil vapors in an elongated reactor is improved by passing the effluent oil vapors and gases from a retort to a thermal cracking unit before the temperature of the retort effluent falls below 680° F. This encourages the more desirable cracking reactions, increases the thermal efficiency of the process, and avoids preheater coking.

5 Claims, 1 Drawing Figure

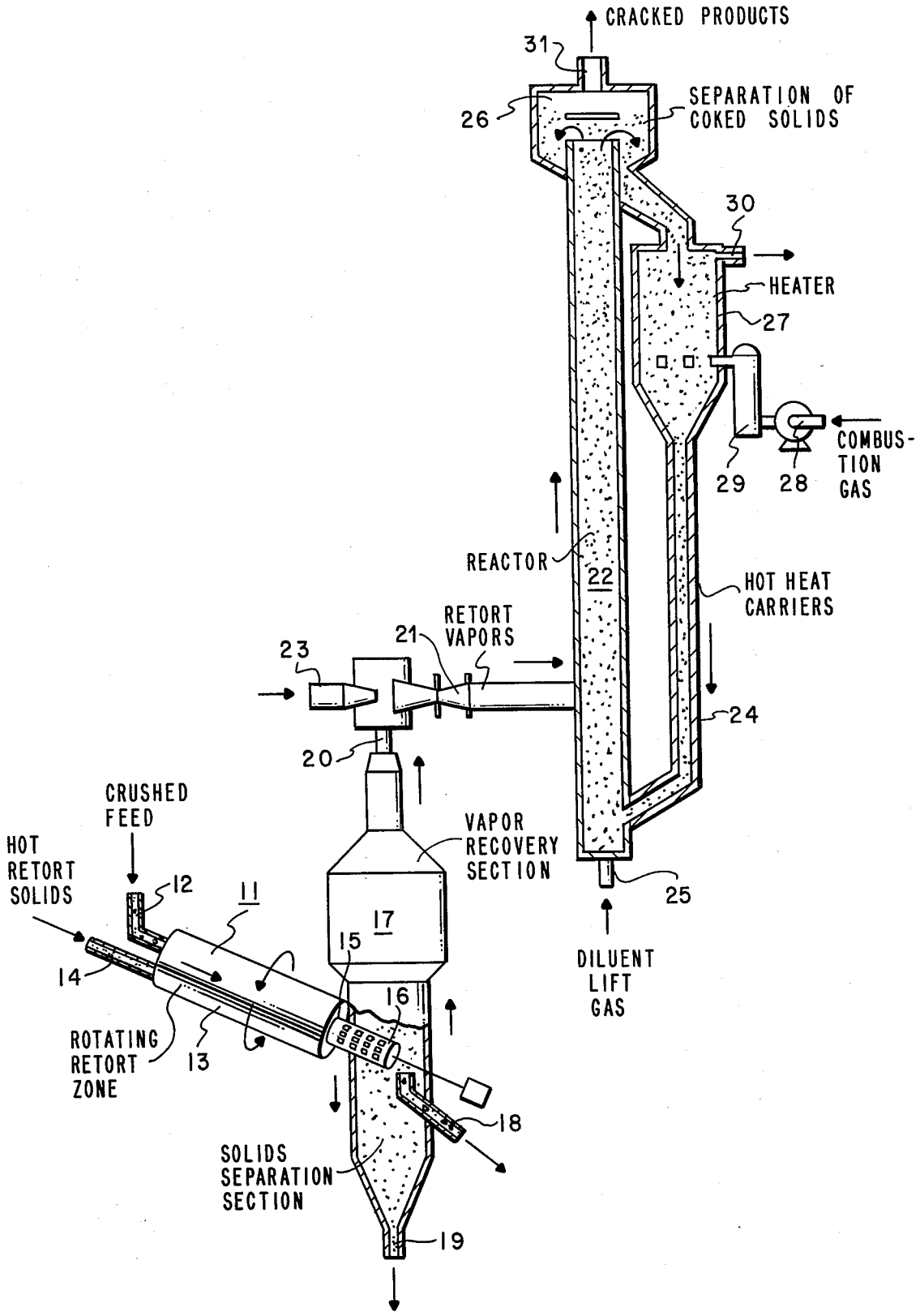
CRACKED PRODUCTS
31
26
SEPARATION OF COKED SOLIDS
30
HEATER
27
COMBUS-TION GAS
29
28
REACTOR
22
HOT HEAT CARRIERS
RETORT VAPORS
21
23
24
20
CRUSHED FEED
HOT RETORT SOLIDS
12
11
VAPOR RECOVERY SECTION
17
15
25
DILUENT LIFT GAS
14
16
ROTATING RETORT ZONE
13
18
SOLIDS SEPARATION SECTION
19

THERMAL CRACKING OF RETORT OIL

BACKGROUND OF THE INVENTION

This invention relates to improving a process for thermal cracking of retort oil in an elongated reactor.

This process is for thermal cracking of the gases and oil vapors produced by retorting oil shale, coal or tar sands. The term retorting denotes thermal conversion of the organic materials in these normally solid hydrocarbonaceous materials at temperatures in excess of 600° F. (315° C.). Retorting produces a retort effluent containing oil vapors, gases, and solid residues. The retort effluent is cooled to separate the gases from the oil. In some processes where the retort vapors contain an excessive amount of matrix solids, the retort effluent is passed through one or more quenchers and strippers to remove a substantial portion of the solids in the oil. Various ways of processing the retort oil have been proposed. The retort oil is usually processed to make a suitable oil for pipelining to the consumer. For example, the oil may be prerefined to a turbine fuel oil. In U.S. Pat. No. 4,080,285, it has been proposed to thermally crack shale oil in an elongated reactor without removing solids from the retort oil. Thermal cracking converts a portion of the retort oil directly into chemical feedstocks like ethylene, propylene, and butenes. This sort of thermal cracking of the retort oil has certain advantages, but the proposed cracking processes involve retort oil that has been separated from the retort gases and that has been cooled. The retort oil is usually reheated in a preheater prior to injecting the oil into the elongated reactor. Heating the retort oil creates coking problems in the heater thereby affecting the yield and product distributions of the cracking process.

SUMMARY OF THE INVENTION

Solid hydrocarbonaceous particles are retorted at temperatures in excess of 700° F. (371° C.) to produce a retort effluent mixture of oil vapors (oil gases and mist) and hydrocarbon gases. The effluent may also contain other gases or vapors produced or used in the retort. Spent matrix solids may also be entrained with the effluent mixture, but for purposes of this disclosure, such solids are not considered as a part of the effluent mixture.

In this disclosure, at least a portion of the retort effluent mixture is passed to an elongated reactor without separating the lighter effluent gases and without allowing the effluent oil vapors and gases to cool to a temperature below 680° F. (360° C.). This mixture encourages the more desirable reactions, increases thermal efficiency and eliminates coking in oil heaters. A diluent lift gas and hot heat carrier solids are added to the reactor. The hot heat carriers are at a temperature of between 1200° F. (649° C.) and 2500° F. (1371° C.) which is above the thermal cracking temperature of the oil in the retort effluent that is fed to the reactor. The diluent gas may be superheated steam and the heat carriers may be inert solids, catalytic solids, or a mixture of inert and catalytic solids. The retort products, diluent gas and heat carrier solids are flowed concurrently through the reactor at a velocity sufficient to entrain the heat carriers in the diluent gas. This thermally cracks the oil to produce methane, ethylene, propylene, butenes, aromatics, gasoline and fuel oil liquids, and light and heavy gas oils, and coke.

BRIEF DESCRIPTION OF THE DRAWING

The drawing is a diagrammatical flow illustration of a system for carrying out a preferred sequence of the improved thermal cracking process of this invention.

DETAILED DESCRIPTION OF THE PREFERRED EMBODIMENTS

As a preliminary stage in the production of hydrocarbon products, the normally solid carbonaceous organic matter in oil shale, coal or tar sands is pyrolyzed or retorted in retort 11 which is operated at a temperature in excess of 700° F. (371° C.). The term retorting denotes thermal conversion of the organic material to oil vapors and gases thereby leaving solid particulate spent matrix or inorganic material. Many processes have been suggested for retorting and retorts are usually operated at an average retort temperature of between 800° F. (426° C.) and 1200° F. (649° C.). Processes for retorting have used direct combustion retorts and retorts heated by a retorting medium with fixed beds, moving beds and fluidized beds. Gas has frequently been used as a retort medium. Other processes use solid heat carrying bodies, such as alumina, metal, sand, ceramic balls, pellets, or particulate solid partially spent matrix material. The preferred embodiment of this invention uses solid heat carrying bodies. In this retorting process, raw or fresh hydrocarbonaceous material which was mined and crushed or ground to a suitable size for handling in a retort system is fed directly from a crusher or from a hopper or accumulator by way of crushed feed inlet line 12 into rotating retort zone 13. At the same time, hot retort solids substantially hotter than the crushed feed material are fed by gravity or other mechanical means to the retort zone by way of hot retort solids inlet pipe 14. The hot retort solids and the hydrocarbonaceous feedstock could be fed to the retort zone by way of a common retort zone inlet if desired. The hydrocarbonaceous feedstock may or may not be preheated by direct or indirect heating means. The feedstock and retorting solids are metered so that the ratio of hot retort solids to feedstock on a weight basis is between 0.5 and 3.5 with a ratio between 1.5 to 2.5 being usually preferred The ratio is such that the sensible heat in the hot retort solids is sufficient to provide at least 50% of the heat required to heat the hydrocarbonaceous feedstock from its feed temperature to the designed retort temperature.

In this description of a preferred embodiment, the retort zone is any sort of horizontal or inclined retort or drum which causes an intimate mixing and tumbling action of the crushed feedstock and the hot retort solids. This type of retort zone is quite flexible over a wide range of conditions and causes rapid solid-to-solid heat exchange between the organic feedstock and the hot retort solids in a way which allows the vapors to separate from the solids without passing up through a long bed of solids and which minimizes dilution of the product vapors. The retorting process is usually carried out in concurrent or parallel flow fashion with the hot retort solids and the organic feedstock being fed into the same end of the retort. The retort zone may be maintained under any pressure which does not hamper efficient operation of the retort. As the retort zone is rotated, the hot retort solids and the crushed feedstock are admixed and the feedstock is rapidly heated by sensible heat transfer from the hot retort solids to the feedstock. Any water in the organic feedstock is distilled and the carbonaceous matter is decomposed, distilled, and cracked into gaseous and condensible oil fractions, thereby forming valuable vapor effluents including gases, oil vapors, and superheated steam. Pyrolysis and vaporization of the carbonaceous matter in the feedstock leaves a particulate spent mineral matrix matter which contains relatively small amounts of unvaporized or coked organic carbon-containing material.

As the retort zone is rotated, the mixture of solids moves toward retort exit 15. Mixture movement is continuous and is aided by the action or design of this type of retort and by continuously withdrawing solids from the exit end of the retort zone. This type of retort zone is especially suited to varying the residence time. The usual residence time is between about 3 to about 20 minutes. The mixture of vapor effluents and solids exits from the retort zone at retort exit 15 at an elevated temperature which depends on the operating temperature of the retort. The retort usually operates at a temperature of between 800° F. (399° C.) and 1100° F. (593° C.). The mixture of vapor effluents and solids passes into revolving screen or trommel 16 which has openings or apertures sized to pass the retort solids and the part of the spent matrix material that is equal to or smaller than the retort solids. The trommel extends into vapor recovery section 17. In the trommel, the gaseous and vaporous effluents with the desired hydrocarbon values separate from the solids and at the same time, at least a portion of the larger spent matrix particles or agglomerates are separated from the remaining solids and pass outward through line 18. The remaining solids pass through the openings in the trommel and drop to the bottom of the vapor recovery section to exit via retort exit line 19 where the solids are processed (not shown) for recovery and reheating of the retorting solids. The separation part of the retorting system may be any sort of exiting and separating system accomplishing the functions mentioned and may be comprised of any number of units of equipment for separating and recovering one or more of these three classes of retort zone materials.

The product vapors and gases resulting from retorting the carbonaceous feedstock are collected overhead in the vapor recovery section and rapidly pass to overhead retort effluent exit line 20 at an exit temperature in excess of 680° F. (360° C.). The usual exit temperature is between about 750° F. (399° C.) and 950° F. (510° C.). Since in this type of retorting system there is no need to use carrier, fluidizing or retorting gases in the retort zone, the vaporous effluent is able to leave the retort essentially undiluted by extraneous fluids except for water or steam vapor derived from the carbonaceous feedstock, or added to prevent or retard carbonization, or added to sweep product vapors from the solids, or added for other reasons. In prior art processes, the product vapors are subjected to separation processes to separate the gases from the oil products and to separate dust or fine solids. Typically, the oil products are cooled to below 680° F. (360° C.) and passed to other stages, if any, of the overall operation.

In the process of this disclosure, the vapors may be subjected to hot dust or fine solids separation and to some quenching or cooling to remove undesirable heavy oils provided that the vaporous products are not cooled to a temperature below 680° F. (360° C.). In other words, the gases in the retort product are not separated. Before the reactor effluent mixture of desired gases and oil products cools to below 680° F. (360° C.), the retort product mixture is passed by way of retort vapor line 20 to educt or line 21 and thence to elongated reactor 22. As shown, some of the diluent gas hereinafter described is injected into the eductor through eductor nozzle 23 to raise the retort products to the desired reactor pressure. The reactor has a low diameter to length ratio, for example, 1:4 to 1:100. The reactor can be in any position, but the vertical position is conventional.

The thermal cracking reactions in the reactor require high temperatures. The heat is primarily supplied by hot heat carriers which are fed to the reactor by way of heat carrier inlet line 24. The hot heat carriers are at a reactor inlet temperature of between 1200° F. (649° C.) and 2500° F. (1370° C.). The preferred temperature is such that the average reactor temperature is between 1300° F. (704° C.) and 1800° F. (982° C.). The feed rate weight ratio of heat carrier solids to retort effluent passing to the reactor is sufficient to provide at least 80 percent of the heat needed for the elongated reactor. The feed rate weight ratio of heat carriers to retort effluent passed to the reactor will be between 2:1 and 200:1. The heat carriers may be catalytic, or catalytically inert, or a mixture of catalytic and inert solids. The heat carriers will be made of material suitable for recovery, reheating, and recycle through the reactor. For example, the heat carriers may be made of catalytically activated or inert alumina, carborundum, ceramics, metal shot, and so on. The particle size and surface area of the heat carriers are not critical, but the size of the heat carriers will be suitable for separation from the reactor gases and for entrainment in the hereinafter mentioned diluent gas.

A diluent lift gas, for example, steam or nitrogen, preferably steam, is supplied to elongated reactor 22 by way of diluent gas inlet line 25. The diluent gas may be heated by way of heat exchange between the diluent gas and the heater combustion gases hereinafter described, or by direct or indirect heat exchange with the hot spent matrix material from the retort. The diluent gas acts as a carrier for the solids and retort effluent products. The diluent gas also acts as a diluent for the hydrocarbonaceous materials thereby reducing their partial pressure and favorably promoting the olefin yields while preventing excessive coking. Steam is preferred because the diluent gas should be easy to separate from the final products of the reactor and because steam assists in vaporizing the carbonaceous materials while possibly producing some hydrogen. The amount of diluent gas added to the reactor will depend upon the residence time of the reactor ingredients and on the amount of gas necessary to provide the desired degree of dilution and velocity for entrainment of the reactor ingredients.

In the elongated reactor, the retort effluent products, the diluent gas, and the heat carriers are concurrently flowed through the reactor at a velocity sufficient to entrain the heat carrier solids in a diluent gas. There may be slippage between the heat carriers and the diluent lift gas. In general, there is no need to charge hydrogen to the reactor, but the hydrogen may be introduced if desired. The direction of flow of the reactor ingredients is not essential, but most commonly, the reactor ingredients will be flowed concurrently upwardly through the reactor. The thermal cracking reaction in the reactor is endothermic; therefore, the highest reactor temperature occurs near the inlet of the hot heat carriers. The average reactor temperature will be below the inlet temperature of the hot heat carriers. The pressure employed in the reactor is not critical, but the pressure is usually related to the overall operation, especially equipment for treating the products from the reactor. The usual pressures are between 1 and 100 psig (0.07 and 7 kilograms per square centimeter). The reactor residence time will usually be between 0.05 and 5 seconds. In general, the residence time will be less than a half a second in order to avoid polymerization reactions and over cracking of the carbonaceous effluent materials from the retort. The product slate from the reactor may be varied depending upon the temperature of the reactor, the residence time, the nature of the carbonaceous material from the retort, the amount of heat carriers used, and the recycle of carbonaceous materials. In the reactor the hydrocarbonaceous materials from the retort undergo thermal cracking to produce a number of cracked products which depend upon the nature of the retort feedstock and the reactor conditions. Some of the more common products are methane, ethane, propane, propylene, butanes, butenes, butadiene, aromatics, gasoling boiling range hydrocarbons, light and heavy gas oils, residual oils, and some coke. The coke is carried out of the reactor with the heat carriers.

The heat carriers, diluent gas, and cracked products pass upward through the reactor where they are usually subjected to a first stage of solids separation. One form of separation, not shown, involves an internal upper reactor arrangement that induces a form of centrifugal separation of the solids from the diluent gas and cracked products. For simplicity purposes, the solids are shown as being separated in enlarged solids disengagement section 26.

Most of the desired size heat carriers passing through the reactor are separated at the outlet of the reactor and are passed to a suitable regenerator or reheater for reheating the heat carriers. For illustrative purposes, heater 27 is shown as a standard catalyst regeneration burner. Additional makeup solids may be added to the regenerator. Reheating of the heat carriers is accomplished in a manner similar to the way that cracking catalyst particles are regenerated, for example, a progressive bed burner. A combustion supporting gas, for example, air, or a mixture of air and fuel gas generated in the process, or flue gas with a desired amount of free oxygen, is blown by way of combustion gas inlet 28 into the heater at a temperature at which the carbonaceous deposits on the heat carriers and other fuel materials will be ignited. If desired, steam may also be used to control burning. The combustion supporting gas may be preheated in preheater 29. The quantity of combustion supporting gas and fuel added to heater 27 will depend upon the desired temperature for the heat carriers and such factors as fuel and heat carrier properties, residence burning time, heat losses and inputs, solids feed rates, and the like. The flue gas from the heater exits by way of heater overhead line 30. The heat in this flue gas may be used to heat the diluent gas or produce steam. The heater produces a stream of hot heat carriers having a temperature of between 1200° F. (649° C.) and 2500° F. (1371° C.) which are recycled by way of hot heat carrier inlet line 24 to the elongated reactor as previously described.

As shown, a stream of raw cracked products leaves the reactor by way of products outlet line 31. It is a common practice to treat this stream of cracked hydrocarbon products to separate solids. For example, a system of quench towers and steam strippers may be used. The bottoms from these systems are laden with solids and some combustible carbon material. The bottoms may be injected into the regenerator to act both as a recycle system for heat carriers and as additional fuel for reheating or regeneration purposes.

The foregoing description of a preferred method of producing hydrocarbon products from thermally cracked retort oil and gas vapors illustrates the novel features and advantages of passing the retort effluents to an elongated thermal cracking unit before the retort effluents have cooled to a temperature which would significantly affect the thermal efficiency or product slate of the thermal cracking reactor. Reasonable variations and modifications are practical within the scope of this disclosure without departing from the spirit and scope of the appended claims.

The embodiments of the invention in which an exclusive property or privilege is claimed are defined as follows:

1. A process for thermal cracking retort oil in an elongated reactor comprising:

(a) operating a retort for normally solid hydrocarbonaceous materials at a temperature above 700° F., thereby producing carbonaceous gases and oil vapors;

(b) passing a mixture of said gases and at least a portion of said oil vapors to said elongated reactor before said mixture has cooled to a temperature below 680° F.; and (c) concurrently flowing said mixture, a gaseous diluent and heat carriers through said elongated reactor at a velocity sufficient to entrain said heat carrier solids, said heat carrier solids being at a reactor inlet temperature of between 1200° F. and 2500° F.

2. The process of claim 1 wherein the hot heat carrier solids are comprised of catalytic solids.

3. The process of claim 1 wherein the hot heat carrier solids are comprised of inert solids.

4. The process of claim 1 wherein the hot heat carrier solids are comprised of a mixture of inert solids and catalytic solids.

5. The process of claim 1 wherein the gaseous diluent is comprised of superheated steam.

* * * * *